US008833320B2

(12) United States Patent
Flender et al.

(10) Patent No.: US 8,833,320 B2
(45) Date of Patent: Sep. 16, 2014

(54) CAMSHAFT FOR AN INTERNAL COMBUSTION ENGINE

(75) Inventors: Thomas Flender, Heimsheim (DE); Michael Kreisig, Stuttgart (DE); Falk Schneider, Korntal-Münchingen (DE)

(73) Assignee: Mahle International GmbH (DE)

( * ) Notice: Subject to any disclaimer, the term of this patent is extended or adjusted under 35 U.S.C. 154(b) by 332 days.

(21) Appl. No.: 12/902,519

(22) Filed: Oct. 12, 2010

(65) Prior Publication Data

US 2011/0083626 A1 Apr. 14, 2011

(30) Foreign Application Priority Data

Oct. 13, 2009 (DE) ..... 10 2009 049 218

(51) Int. Cl.
*F01L 1/02* (2006.01)
*F01M 1/06* (2006.01)
*F01L 1/047* (2006.01)

(52) U.S. Cl.
CPC ..... *F01L 1/047* (2013.01); *F01L 2103/00* (2013.01); *F01L 2001/0476* (2013.01)
USPC ..... 123/90.31; 123/90.34

(58) Field of Classification Search
USPC ..... 123/90.16–18, 90.33–34, 90.37, 90.6; 74/567; 384/251, 420, 424
See application file for complete search history.

(56) References Cited

U.S. PATENT DOCUMENTS

| | | | | |
|---|---|---|---|---|
| 5,123,385 | A | 6/1992 | Sado et al. | |
| 5,937,812 | A * | 8/1999 | Reedy et al. | 123/90.34 |
| 5,947,070 | A * | 9/1999 | Immel et al. | 123/90.6 |
| 7,047,923 | B2 * | 5/2006 | Schafer et al. | 123/90.16 |
| 7,314,031 | B2 * | 1/2008 | Le Troadec et al. | 123/90.6 |
| 2004/0211376 | A1 * | 10/2004 | Mae et al. | 123/90.6 |
| 2005/0081678 | A1 * | 4/2005 | Smith et al. | 74/594.1 |
| 2008/0257290 | A1 * | 10/2008 | Lettmann et al. | 123/90.17 |
| 2009/0199797 | A1 | 8/2009 | Schafer et al. | |
| 2010/0000477 | A1 * | 1/2010 | Schneider | 123/90.6 |
| 2010/0108004 | A1 * | 5/2010 | Lettmann et al. | 123/90.17 |
| 2011/0265756 | A1 * | 11/2011 | Flender et al. | 123/193.5 |

FOREIGN PATENT DOCUMENTS

WO WO 2008028902 A1 * 3/2008

* cited by examiner

*Primary Examiner* — Thomas Denion
*Assistant Examiner* — Steven D Shipe
(74) *Attorney, Agent, or Firm* — Rader, Fishman & Grauer PLLC

(57) ABSTRACT

An internal combustion engine, having a camshaft having at least one one-piece thrust plate, which is arranged and captively fixed between a drive element, and a function element, wherein the drive element and the function element are fixedly joined with the camshaft, wherein the thrust plate is in the cylinder crankcase and is an axial bearing plate and includes at least one of a wear reducing coating and a friction reducing coating, and wherein the thrust plate is guided at a radially outer edge in the cylinder crankcase

7 Claims, 1 Drawing Sheet

CAMSHAFT FOR AN INTERNAL COMBUSTION ENGINE

CROSS-REFERENCES TO RELATED APPLICATION

This application claims priority to German application DE 10 2009 049 218.6 filed on Oct. 13, 2009, which is hereby incorporated by reference in its entirety.

TECHNICAL FIELD

The present invention relates to a camshaft for an internal combustion engine.

BACKGROUND

Camshafts are necessary for actuating intake and exhaust valves in internal combustion engines and are well known at least among experts involved therewith. Due to the complexity of modern camshafts, however, the assembly and mounting of the same becomes increasingly more difficult.

SUMMARY

The present invention is therefore concerned with the problem to provide an improved or at least an alternative embodiment for a camshaft for an internal combustion engine which, in particular, can be handled in a simpler manner.

This problem is solved according to the invention by the subject matters of the independent claims. Advantageous embodiments are subject matter of the dependent claims.

The present invention is based on the general idea to form a so-called thrust plate for a camshaft of an internal combustion engine as one piece, this means closed, and to position it captively between a drive wheel/drive element/element fixedly joined with the camshaft and a bearing ring/cam/functional element which is also fixedly joined with the camshaft. This results in a considerably simplified part handling, in particular in the supplying industry, and moreover, in a considerably simplified mounting of the camshaft in the cylinder crankcase because, in the present case, the camshaft can preferably be mounted in the cylinder crankcase in a completely pre-assembled state, that is, with the bearing ring/cam and drive wheel/drive element joined thereon, without the need that the thrust plate has still to be mounted thereon. In fact, the latter is already positioned in advance, e.g. by the supplier, between the drive wheel/drive element and the bearing ring/cam and is captively retained by fixedly joining the drive wheel and the bearing ring on the camshaft. Generally, hereinafter, the term "drive element" is to be understood in general as a drive wheel and the term "functional element" is to be understood as a bearing ring or cam.

In an advantageous development of the solution according to the invention, the drive wheel/drive element and the functional element/the cam are axially spaced apart from one another and support the thrust plate therebetween. By adjusting the axial distance between functional element and drive element, the axial play available for the thrust plate can be exactly adjusted, whereby a particularly high manufacturing accuracy and therefore a particularly high manufacturing quality can be achieved.

Moreover, in this embodiment it can be provided according to the invention that the camshaft comprises a rinsing bore in the area of the thrust plate, that is, in the area of the axial distance between the drive element and the functional element. Such a rinsing bore, usually also called blow-out bore, is thus located in the area of the seat of the thrust plate for rinsing off grinding residues, whereby again an increased manufacturing quality can be achieved.

In an alternative embodiment, the drive element and the functional element abut directly against each other, wherein the thrust plate is arranged in a recess of the drive element and/or the functional element and wherein said recess is axially limited by the respective opposing and abutting functional element or drive element. Thus, the recess at the functional element and/or drive element is open on the front side and is axially limited on this front side by the opposing drive element or the opposing functional element. Of course, the recess can be provided entirely on the functional element or entirely on the drive element or partially on each of the two components which are fixedly joined with the camshaft. Hereby, a particularly high flexibility with respect to the manufacturing of the camshaft according to the invention can be achieved.

Further important features and advantages arise from the sub-claims, from the drawings, and from the associated description of the figures based on the drawings.

BRIEF DESCRIPTION OF THE DRAWING

It is to be understood that the above mentioned features and the features yet to be explained hereinafter can be used not only in the respectively mentioned combination but also in other combinations or alone without departing from the scope of the present invention.

Preferred exemplary embodiments of the invention are illustrated in the drawings and are explained in the following description in more detail, wherein identical reference numbers refer to identical, or similar, or functionally identical components.

Figure 1:
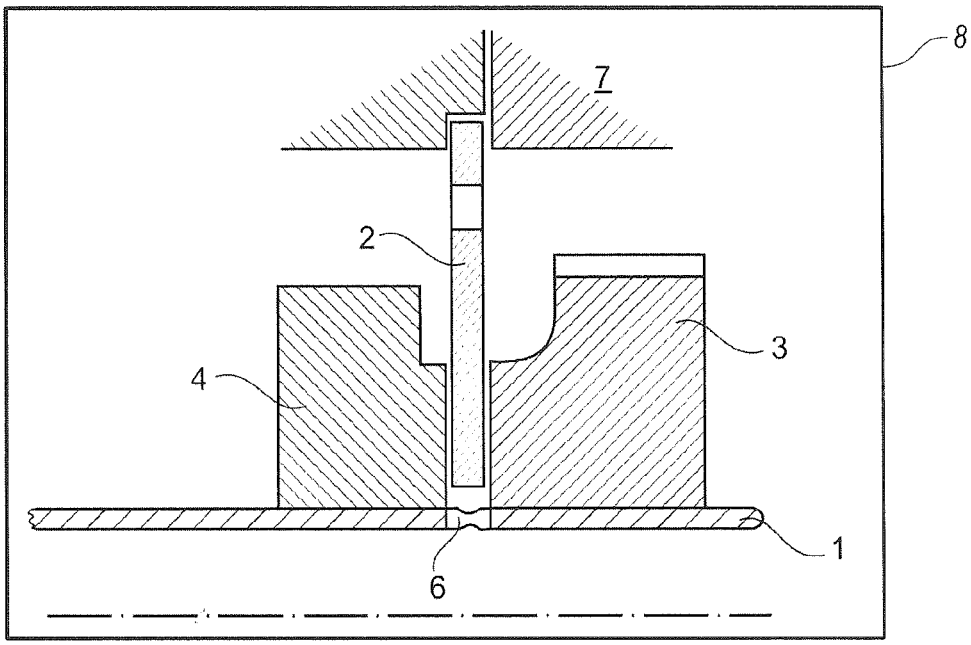
Figure 2:
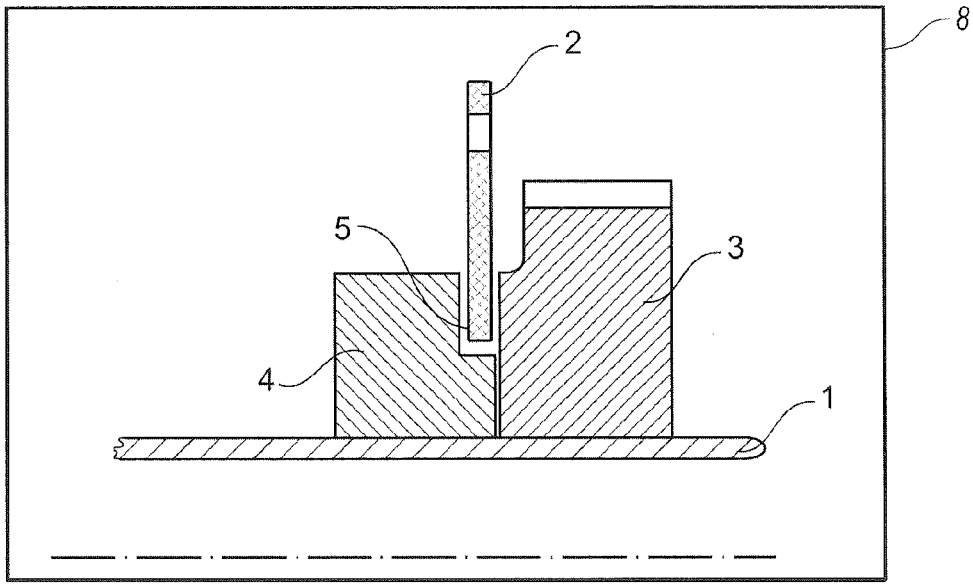

In the figures, schematically,

FIG. 1 shows a sectional view through a camshaft according to the invention in a first embodiment, FIG. 2 shows a sectional view as in FIG. 1 but of a further embodiment.

DETAILED DESCRIPTION

According to FIG. 1, a camshaft 1 according to the invention comprises a one-piece thrust plate 2 which is arranged between a drive element 3 which is fixedly joined with the camshaft 1 and a functional element 4 which is also fixedly joined with the camshaft 1, whereby the thrust plate is captively fixed. The drive element 3 can be configured, for example, as drive gear and can be connected to a crankshaft of an internal combustion engine 8. Generally, the embodiments according to the FIGS. 1 and 2 are comparable with each other; however, according to FIG. 1, the drive element 3 and the functional element 4 are axially spaced apart from one another and support the thrust plate 2 therebetween. In contrast, according to FIG. 2, the drive element 3 and the functional element 4 abut against one another and thus are not axially spaced apart from one another so that in this case, the thrust plate 2 is arranged in a recess 5 of the functional element 4. Here, according to FIG. 2, the recess 5 is solely arranged in the functional element 4 and is axially limited by the drive element 3. Of course, it is also conceivable that, alternatively, the recess 5 is at least partially arranged in the drive element 3 and is limited in axial direction by the functional element 4 abutting against the drive element 3.

When viewing FIG. 1 it is apparent that in the area of the thrust plate 2, the camshaft 1 has a rinsing bore 6 which can also be designated as so-called blow-out bore and by means of which penetrated grinding dust can be blown off or rinsed of prior to the final assembly.

As is shown only in FIG. 1, the thrust plate 2 can additionally be guided at a radially outer edge in the cylinder crankcase 7 and thereby can serve as axial bearing plate. In this case, the thrust plate 2 functions additionally as axial bearing of the camshaft 1. To allow an operation of the internal combustion engine equipped with the camshaft according to the invention as maintenance-free and efficient as possible, the thrust plate 2 can also comprise a wear- and/or friction-reducing coating.

In general, the camshaft according to the invention offers the following advantages: First of all, during service as well as during the first assembly, the thrust plate is captively retained by the functional element 4 on the one hand and by the drive element 3 on the other. In addition, it is possible to exactly adjust an axial play of the thrust plate 2 by means of the two adjacent components 3 and 4 and in particular to use a one-piece thrust plate 2. The axial play can be adjusted via the geometry of the functional element 4 or via a joining dimension of the adjacent components 3 and 4. Thereby, the handling of the camshaft 1 is made considerably simpler, in particular for the supplier. At the same time, the mounting of the camshaft 1 according to the invention in the cylinder crankcase is also simplified.

The invention claimed is:

1. A camshaft, comprising:

at least one one-piece thrust plate, which is arranged and captively fixed between a drive element, fixedly joined with the camshaft; and a function element in the form of a bearing, which is also fixedly joined with the camshaft, wherein the thrust plate comprises at least one of a wear reducing coating and a friction reducing coating;

wherein the thrust plate is axially guided at a radially outer edge by a cylinder crankcase and at the outer edge of the thrust plate, thereby serving as an axial bearing plate; and wherein the drive element and the functional element abut axially against one another and the thrust plate is arranged in a recess of at least one of the drive element and the functional element, wherein the recess is axially limited by the abutting relationship of the functional element and the drive element.

2. The camshaft according to claim 1, wherein the drive element is a drive wheel.

3. The camshaft according to claim 1, wherein the bearing is a ring.

4. The camshaft according to claim 1, wherein the camshaft comprises a rinsing bore in an area of the thrust plate.

5. An internal combustion engine, comprising: a camshaft having at least one one-piece thrust plate, which is arranged and captively fixed between a drive element, and a function element, wherein the drive element and the function element are fixedly joined with the camshaft, wherein the thrust plate is in the cylinder crankcase and is an axial bearing plate and includes at least one of a wear reducing coating and a friction reducing coating, wherein the thrust plate is guided at a radially outermost edge that is within the cylinder crankcase, and wherein the drive element and the functional element abut axially against one another and the thrust plate is arranged in a recess of at least one of the drive element and the functional element, wherein the recess is axially limited by the abutting relationship of the functional element and the drive element.

6. The engine according to claim 5, wherein the drive element is a drive wheel and the function element is a bearing ring.

7. The engine according to claim 5, wherein the camshaft comprises a rinsing bore in an area of the thrust plate.

* * * * *